United States Patent [19]

Watanabe

[11] Patent Number: 4,861,036

[45] Date of Patent: Aug. 29, 1989

[54] MULTI-LEVEL CROSSING MAZE TOY

[76] Inventor: Tsutomu Watanabe, 515-1, Otake, Sodegaura-machi, Kimitsu-gun, Chiba-ken, Japan

[21] Appl. No.: 265,581

[22] Filed: Nov. 1, 1988

[30] Foreign Application Priority Data

Nov. 4, 1987 [JP] Japan ..... 62-168648[U]

[51] Int. Cl.[4] ..... A63B 67/14; A63B 67/00; A63F 9/06

[52] U.S. Cl. ..... 273/113; 273/109; 273/153 R; 273/1 GA

[58] Field of Search ..... 273/113, 115, 153 S

[56] References Cited

U.S. PATENT DOCUMENTS

| | | | |
|---|---|---|---|
| 3,840,234 | 10/1974 | Felsten | 273/113 |
| 4,008,895 | 2/1977 | Reiner et al. | 273/113 |
| 4,494,753 | 1/1985 | Wampler | 273/113 |
| 4,545,577 | 10/1985 | Randleman | 273/113 |

FOREIGN PATENT DOCUMENTS

| | | | |
|---|---|---|---|
| 1146275 | 11/1957 | France | 273/153 R |

*Primary Examiner*—Edward M. Coven
*Assistant Examiner*—Gary Jackson
*Attorney, Agent, or Firm*—Toren, McGeady & Associates

[57] ABSTRACT

In a multi-level crossing maze toy, nine kinds of single cubes of the same size in the number as desired are combined longitudinally, laterally and thicknesswise to form a combined cube, the combined cube being formed in two surface thereof with an entrance and an exit open thereto, opening of the cube are singly associated when the combined cube is formed, and a dead end passage, a linear passage, a curved passage, a T-passage, a right-angle three-forked passage, a cross passage, a five-forked passage and a six-forked passage formed interiorly of a single cube are freely placed in communication with one another to form a multi-level crossing maze. Therefore, a ball is introduced into the multi-level crossing maze from the entrance of the combined cube to which is connected the single cube, and the combined cube is operated to move the ball and remove it from the exit.

4 Claims, 4 Drawing Sheets

MULTI-LEVEL CROSSING MAZE TOY

BACKGROUND OF THE INVENTION

A conventional ball carrying toy has been proposed in which an iron ball is rolled from a start portion to a goal portion of a passage formed by pins or the like on a double-construction upper plate surface, and a circular opening for causing the iron ball to be fallen on a lower plate surface to return it to the start portion and a narrow communication passage are aligned in a suitable location of said passage. A further proposal has been made in which as disclosed in Japanese Utility Model Publication No. 28637/1983, a plurality of annular squares mutually associated are incorporated into a cube, a portion of the start end to the terminal of the cube is communicated by through-holes formed in the sides of the plurality of annular squares and a Celluloid ball with a bell inserted therein is inserted from the top interiorly of the cube and removed from the lower portion.

In the conventional ball carrying toy, a ball is moved from the upper portion to the lower portion within a box incorporated in plane or in cubic, and merely passes through the determined passage, and therefore, it is possible to reduce the moving time from the start portion to the goal portion through the technical exercise but a brain judgement, a thinking power and a patience cannot be naturally learned.

SUMMARY OF THE INVENTION

The present invention relates to a multi-level crossing maze toy suitable for use with a maze game in which a ball introduced into a maze to compete for time from an entrance to an exit of the maze.

It is an object the present invention provide a means in which a complicated maze invisible from outside is formed interiorly of a combined cube or a complicated maze a part or whole of which can be seen through from the out side is formed so that one may remind of the structure of the maze and pleasantly naturally learn the brain judgement, thinking power and patience.

It is a further object of the present invention provides a means in which a complicated maze invisible from outside is formed interiorly of a combined cube or a complicated maze a part or whole of which can be seen through from the outside is formed the predetermined maze by a combined hexahedron which is combined and adhered to one another the single cubes.

It is another object of the present invention to provide a means in which a combined hexahedron is held within a frame or box and said combined hexahedron can be seen or can not be seen through from the outside is formed so that a maze is formed at each occasion a desirable structure by combining the single cubes.

DETAILED DESCRIPTION OF THE INVENTION

Figure 1:
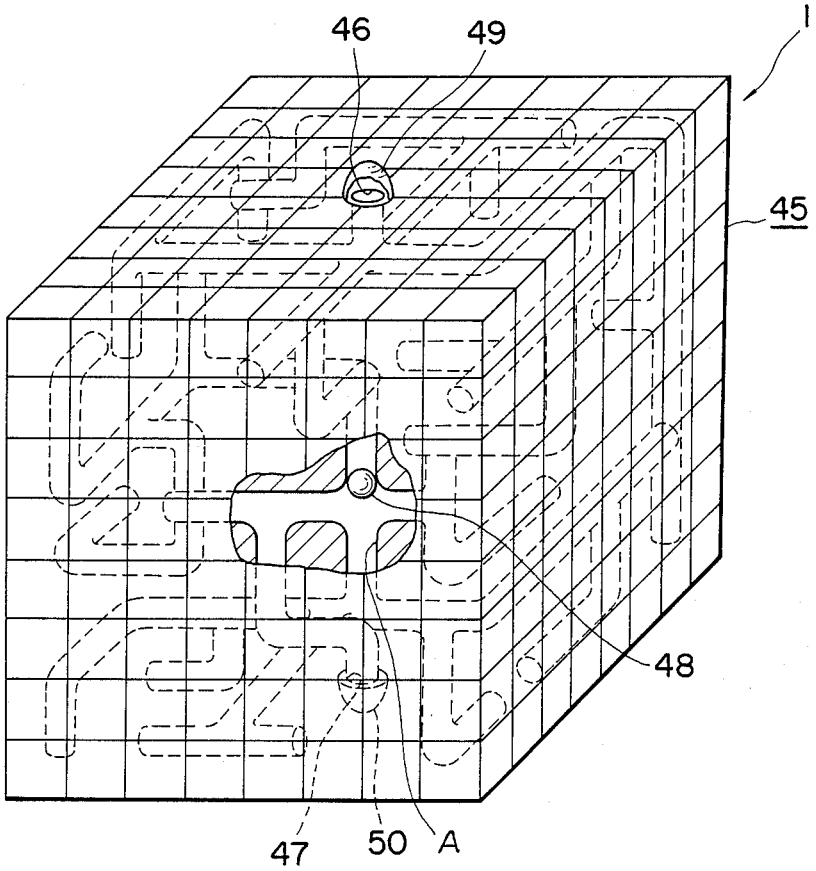
FIG. 1 is a partly cutaway perspective view of a multi-level crossing maze toy according to the present invention.
Figure 2:
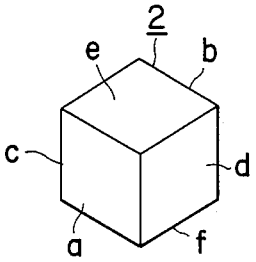
FIG. 2 is a perspective view of a solid single cube.
Figure 3:
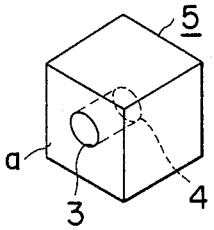
FIG. 3 is a perspective view of a first single cube having a dead end passage.
Figure 4:
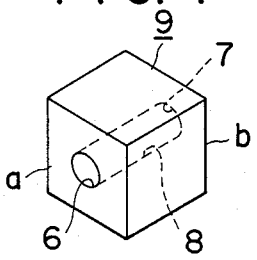
FIG. 4 is a perspective view of a second single cube having a linear passage.
Figure 5:
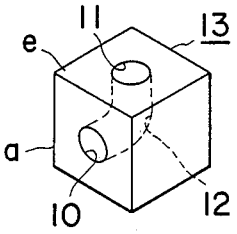
FIG. 5 is a perspective view of a third single cube having a curved passage.
Figure 6:
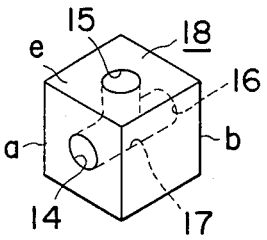
FIG. 6 is a perspective view of a fourth single cube having a T-passage.
Figure 7:
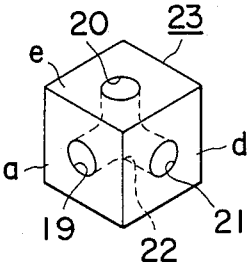
FIG. 7 is a perspective view of a fifth single cube having a right-angled three-forked passage.
Figure 8:
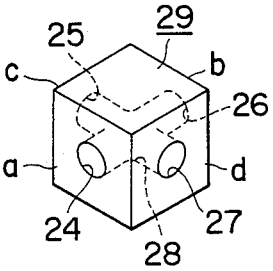
FIG. 8 is a perspective view of a sixth single cube having a cross passage.
Figure 9:
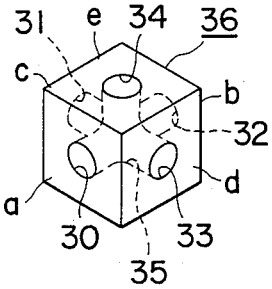
FIG. 9 is a perspective view of a seventh cube having a five-forked passage.
Figure 10:
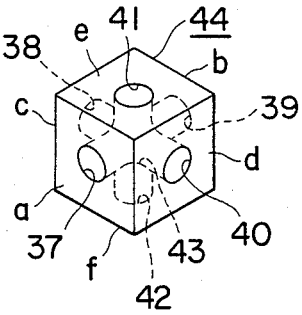
FIG. 10 is a perspective view of an eighth single cube having a six-forked passage.

An embodiment of the present invention will be described with reference to FIGS. 1 to 10. A multi-level crossing maze toy 1 comprises the desired number of a solid single cube 2 having no opening in six surfaces of the cube, i.e., a front surface portion (a), a back surface portion (b), a left surface portion (c), a right surface portion (d), an upper surface portion (e) and a bottom surface portion (f), a first single cube 5 formed in its front surface portion (a) with a circular opening 3 and having a dead end passage 4 continuous to the circular opening 3 and having same size as that of the filled cube 2, a second single cube 9 formed in its front surface portion (a) with a circular opening 6 and in its back surface portion (b) with a circular opening 7 and having a linear passage 8 continuous to the circular openings 6 and 7 and having the same size as that of the solid single cube 2, a third single cube 13 formed in its front surface portion (a) with a circular opening 10 and in its upper surface portion (e) with a circular opening 11 and having a curved passage 12 continuous to these circular openings 10 and 11 and having the same size as that of the solid single cube 2, a fourth single cube 18 formed in its front surface portion (a) with a circular opening 14, in its upper surface portion (e) with a circular opening 15 and in its back surface portion (b) with a circular opening 16 and having a T-passage 17 continuous to these circular openings 14 and 15 and having the same size as that of the solid single cube 2, a fifth single cube 23 formed in its front surface portion (a) with a circular opening 19, in its upper portion (e) with a circular opening 20 and in its right surface portion (d) with a circular opening 21 and having a right-angled three-forked passage 22 crossing at right angles to and continuous to these circular openings 19, 20 and 21 and having the same size as that of the solid single cube 2, a sixth single cube 29 formed in its front surface portion (a) with a circular opening 24, in its left surface portion with a circular opening 25, in its back surface portion (b) with a circular opening 26 and in its right surface portion (d) with a circular opening 27 and having cross passage 28 crossing to and continuous to these circular openings 24, 25, 26 and 27 and having the same size as that of the filled cube 2, a seventh single cube 36 formed in its front surface portion (a) with a circular opening 30, in its left surface portion (c) with a circular opening 31, in its back surface portion (b) with a circular opening 32, in its right surface portion (d) with a circular opening 33 and in its upper surface portion (e) with a circular opening 34 and having a five-forked passage 35 continuous to these circular openings 30, 31, 32, 33 and 34 and having the same size as that of the filled cube 2, and an eighth single cube 44 formed in its front surface portion (a) with a circular opening 37, in its left surface portion (c) with a circular opening 38, in its bottom surface portion (f) with a circular opening 39, in its right surface portion (d) with a circular opening 40, in its upper surface portion (e) with a circular opening 41 and in its bottom surface portion (f) with a circular opening 42 and six-forked passage 43 crossing to and continuous to these circular openings 37, 38, 39, 40, 41 and 42 and having the same size as that of the solid single cube 2, said cubes being longitudinally, laterally and thicknesswise combined and adhered to one another to form a combined hexahedron 45, said combined hexahedron 45 having two surface formed with an entrance 46 and an exit 47 by making use of any of the circular openings of said cubes 9, 13, 18, 23, 29, 36 and 44, a multi-level crossing maze (A) leading to the entrance 46 and the exit 47 being formed, whereby a ball 48 such as an iron ball is introduced into the multi-level crossing maze (A) through the entrance 46 and the combined cube 45 is rotated or oscillated to move the ball 48 within the multi-level crossing maze (A) and remove the ball 48 from the exit 47. In this case, the entrance 46 and the exit 47 are arranged in said order but this arrangement can be reversed. Reference numerals 49 and 50 designate a detachable lid which can prevent the ball 48 being fallen.

With the arrangement as described above, according to the present invention, the multi-level crossing maze toy 1 has the combined cube 45 composed of a combination of nine kinds of the single cubes 2, 5, 9, 13, 18, 23, 29, 36 and 44, within which cube 45 are freely communicated and formed the dead end passage 4, the linear passage 8, the curved passage 12, the T-passage 17, the right-angled three-forked passage 22, the cross passage 28, the five-forked passage 35 and the six-forked passage 43 to form the complicated multi-level crossing maze (A), wherein the ball 48 is put through the entrance 46 in the two surface of the combined hexahedron 45 and the ball 48 is rolled and moved within the complicated multi-level crossing maze (A) and can be removed from the exit 47.

Figure 11:
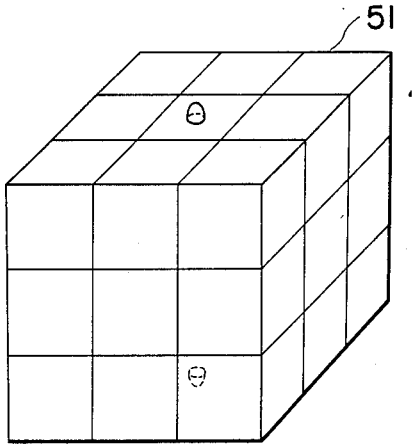
FIG. 11 is a perspective view of a multi-level crossing maze toy according to the present invention comprising a combined hexahedron having three rows in a longitudinal direction, three rows in a lateral direction, and three rows thicknesswise.
Figure 12:
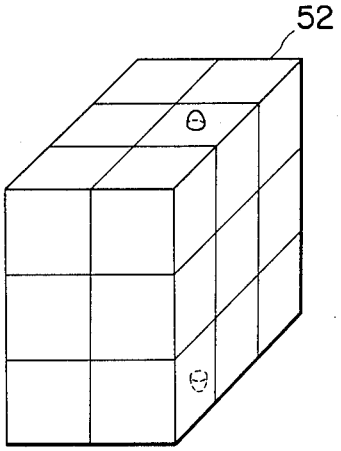
FIG. 12 is a perspective view of a multi-level crossing maze toy according to the present invention comprising a combined hexahedron having three rows in a longitudinal direction, two rows in a lateral direction and three rows thicknesswise.
Figure 13:
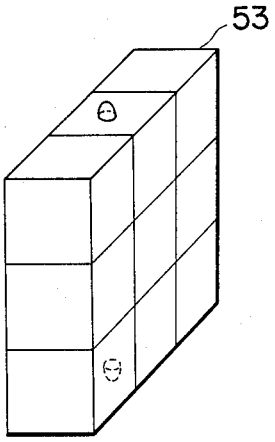
FIG. 13 is a perspective view of a multi-level crossing maze toy according to the present invention comprising a combined hexahedron having three rows in a longitudinal direction, one row in a lateral direction and three rows thicknesswise.

FIG. 11 shows a combined hexahedron 51 having three rows in a longitudinal direction, three rows in a lateral direction, and three rows thicknesswise; FIG. 12 shows a combined hexahedron 52 having three rows in a longitudinal direction, three rows in a lateral direction and three rows thicknesswise; and FIG. 13 shows a combined hexahedron 53 having three rows in a longitudinal direction, three rows in a lateral direction and three rows thicknesswise, in which the whole or a part of the required ones out of the combined solid single cube and the single cubes is a transparent cube so that the movement of the ball may be seen through.

Figure 14:
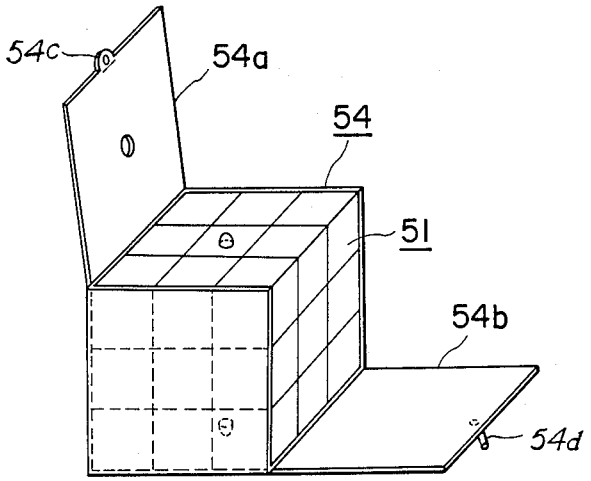
FIG. 14 is a perspective view of a multi-level crossing maze toy according to the present invention in which a combined hexahedron shown in FIG. 11 is inserted into a frame or a box.
Figure 15:
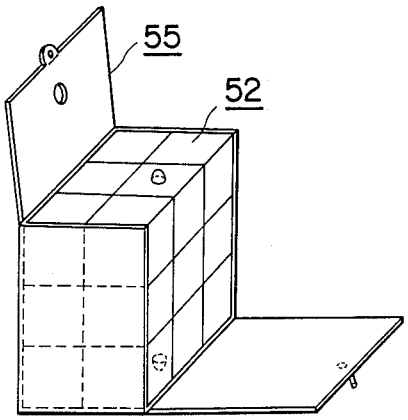
FIG. 15 is a perspective view of a multi-level crossing maze toy according to the present invention in which a combined hexahedron shown in FIG. 12 is inserted into a frame or a box.
Figure 16:
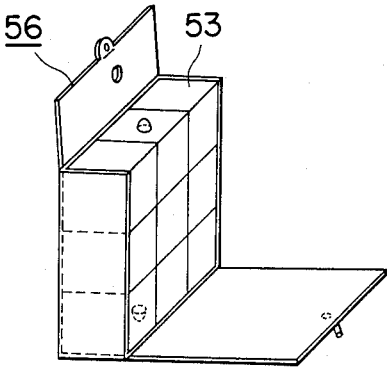
FIG. 16 is a perspective view of a multi-level crossing maze toy according to the present invention in which a hexahedron shown in FIG. 13 is inserted into a frame or a box.

FIG. 14 shows an arrangement wherein the combined hexahedron 51 is inserted into a transparent frame or a box 54, lids 54*a* and 54*b* are closed, and the combined hexahedron 51 which does not adhere each other and independent is held by stoper 54*c* and 54*d* and made to be transparent or not transparent so that the desirable multi-level crossing maze is formed pleasure. FIG. 15 shows an arrangement wherein the combined hexahedron 52 is held within a frame or a box 55; and FIG. 16 shows an arrangement wherein a combined hexahedron 57 is held within a frame or a box 56.

In the multi-level crossing maze toy according to the present invention, the combined single cube is interiorly formed with the complicated multi-level crossing maze invisible or visible from the outside or the multi-level crossing maze a part or the whole of which can be seen through to cause a player to remind of the structure of this multi-level crossing maze so that the ball is moved from the start portion of the entrance or exit to the goal portion the entrance or exit to compete a speed. This toy is rich in variety as compared with a conventional plane maze or a ball carrying toy, and a high-degree and inter esting game can be enjoyed, and in addition, the brain judgement, thinking power and patience can be naturally learned.

What is claimed is:

1. A multi-level crossing maze toy comprising a combination of the required number of solid single cubes, first single cubes formed in its front surface with a circular opening and having a dead end continuous to said circular opening and having the same size as that of said solid single cube, second single cubes formed in its front and back surface portion with a circular opening and having a linear passage continuous to said circular opening and having the same size as that of said solid single cube, third single cubes formed in its front and upper surface portion with a circular opening and having a curved passage continuous to said circular opening and having the same size as that of said solid single cube, fourth single cubes formed in its front surface, upper surface and back surface portions with a circular opening and having a T-passage continuous to said circular opening and having the same size as that of said solid single cube, fifth single cubes formed in its front surface, upper surface and right surface portions with a circular opening and having a right-angled three-forked passage crossing at right angles to and contonuous to said circular opening and having the same size as that of said solid single cube, sixth single cubes formed in its front surface, left surface, back surface and right surface portions with a circular opening and having a cross passage continuous to said circular opening and having the same size as that of said solid single cube, seventh single cubes formed in its front surface, left surface, back surface, right surface and upper surface portions with a circular opening and having the same size as that of said solid single cube, and eighth single cubes formed in its front surface, left surface, back surface, right surface, upper surface and bottom surface portions with a circular opening and having a six-forked passage crossing to and continuous to said circular opening and having the same size as that of said solid single cube to form a combined hexahedron, a multi-level crossing maze in which said combined hexahedron has two surface formed with an entrance or an exit is formed, and an insertable ball is movably introduced into said multi-level crossing maze.

2. The multi-level crossing maze toy according to claim 1 wherein said solid single cube, said first single cube, said second single cube, said third single cube, said fourth single cube, said fifth single cube, said sixth single cube, said seventh single cube and said eighth single cube are transparent cubes.

3. The multi-level crossing maze toy according to claims 1 or 2 wherein any of said solid single cubes, and said first to eighth single cubes in the number more than two are combined and adhered to one another.

4. A multi-level crossing maze toy according to claim 1 or 2 in which a combined hexahedron comprising a combination of any of said solid single cubes, and said first to eighth single cubes in the number more than two is held within a frame or a box.

* * * * *